United States Patent [19]

Suska

[11] 4,131,969

[45] Jan. 2, 1979

[54] SECURITY STUD FOR HINGES

[75] Inventor: Charles R. Suska, Roxbury, Conn.

[73] Assignee: The Stanley Works, New Britain, Conn.

[21] Appl. No.: 802,365

[22] Filed: Jun. 2, 1977

[51] Int. Cl.[2] ..... E05D 11/00

[52] U.S. Cl. ..... 16/137

[58] Field of Search ..... 16/137, 136, 175, 159, 16/162; 292/300; 70/417

[56] References Cited

U.S. PATENT DOCUMENTS

| | | | |
|---|---|---|---|
| 30,970 | 12/1860 | Johnson | 16/128 |
| 114,579 | 3/1871 | Marston | 16/137 X |
| 905,201 | 12/1908 | Magnusen | 16/137 |
| 1,113,278 | 10/1914 | Zobel | 16/137 |
| 1,391,304 | 9/1921 | Dowling | 16/137 |
| 1,412,875 | 4/1922 | Knuth | 16/137 |
| 1,421,746 | 7/1922 | Thorne | 292/300 |
| 1,446,589 | 2/1923 | Shaw | 70/417 |
| 1,593,684 | 7/1926 | Anakin | 70/417 X |
| 1,635,920 | 7/1927 | Belvin | 292/300 |
| 1,786,221 | 12/1930 | Phillips | 70/417 |
| 2,015,248 | 9/1935 | Williams | 70/417 X |
| 2,571,633 | 10/1951 | Vogel | 16/137 |
| 2,797,432 | 7/1957 | Gakle | 16/137 |
| 3,844,019 | 10/1974 | Shwayder et al. | 70/417 X |
| 3,937,506 | 2/1976 | Dean | 16/137 |
| 3,970,340 | 7/1976 | Taft | 292/300 |
| 3,976,434 | 8/1976 | Shwayder | 70/417 X |
| 4,013,311 | 3/1977 | Prezioso | 70/417 X |
| 4,057,873 | 11/1977 | Bursani | 16/137 |

FOREIGN PATENT DOCUMENTS

| | | | |
|---|---|---|---|
| 502999 | 7/1930 | Fed. Rep. of Germany | 16/137 |
| 600670 | 7/1934 | Fed. Rep. of Germany | 16/137 |
| 964465 | 8/1950 | France | 16/137 |

*Primary Examiner*—Ronald Feldbaum
*Attorney, Agent, or Firm*—Brumbaugh, Graves, Donohue & Raymond

[57] ABSTRACT

An improved hinge comprising a saw-resistant security stud which functions to inhibit any movement other than the normal intended pivotal movement of the hinge.

17 Claims, 7 Drawing Figures

FIG. 1
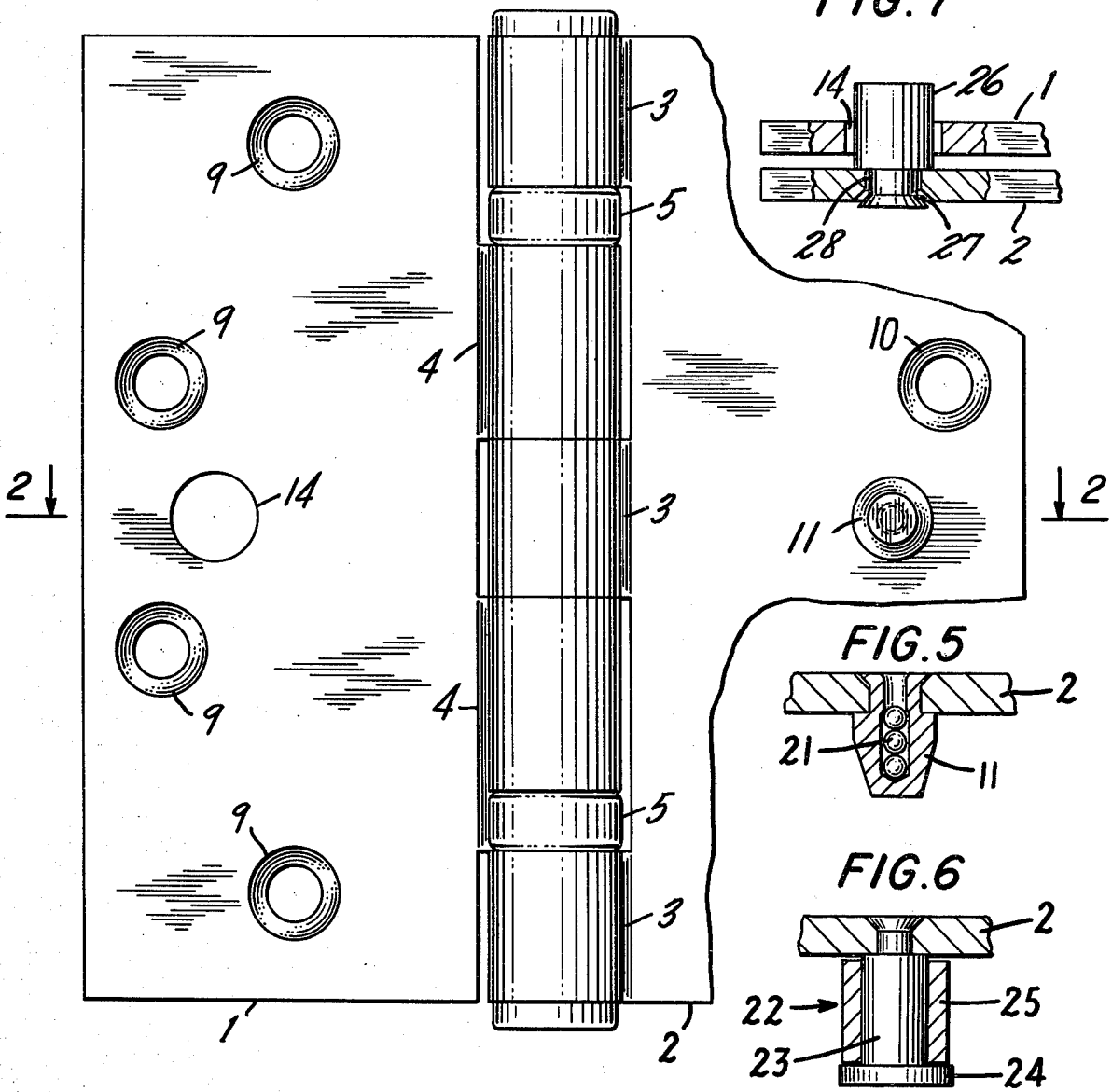
FIG. 7
FIG. 5
FIG. 6
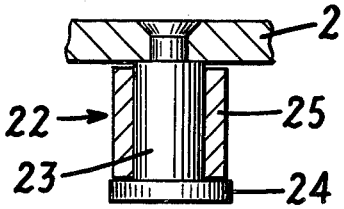
FIG. 2
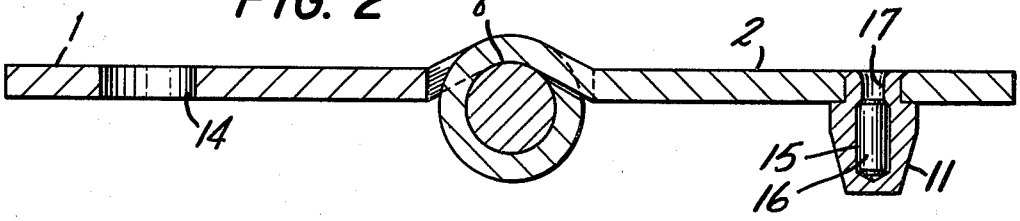
FIG. 3
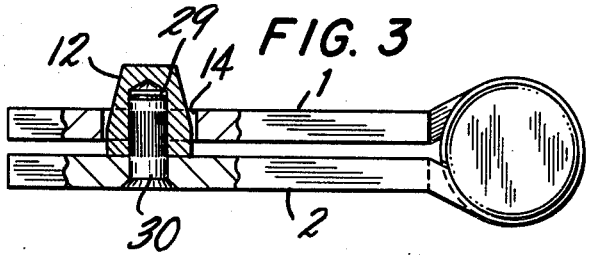
FIG. 4
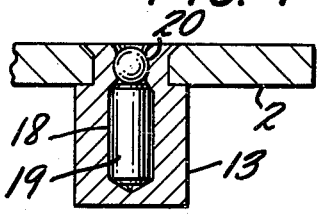

SECURITY STUD FOR HINGES

BACKGROUND OF THE INVENTION

This invention relates to a door hinge with improved security characteristics for preventing entry by burglars, vandals, trespassers and the like.

As used in doors which open outwardly, conventional hinges possess the fault that surreptitious entry may be gained by removing the hinge pins and pulling the door outwardly from its frame. In the past there have been various proposals for preventing such forced entry, such as by securing the hinge pin with a locking pin inaccessable when the door is closed, thus preventing removal of the hinge pin; for example, see U.S. Pat. No. 3,621,512.

Various arrangements have also been proposed to prevent opening of a door when the hinge pin has been removed or the hinge knuckles sawed through, and the door is closed and locked. Such devices have consisted of structures which interact when the leaves of the hinge are in their overlapping, i.e., closed position, so as to prevent relative parallel movement. An example is shown in U.S. Pat. No. 30,970 to Johnson which employs a stud attached to one leaf for entering an opening in the opposite leaf when the hinge is closed.

The aforementioned hinges possess the disadvantage of being ineffective against an intruder who possesses a hacksaw blade or the like. In the case where the hinge pin is made tamper resistant, the entire knuckle-hinge pin assembly may be sawed off and the door thereby removed. Also, where a stud-aperture interlock is employed, the door may be removed by removing the hinge pins or sawing off the knuckles or barrel, and then sawing through the stud.

SUMMARY OF THE INVENTION

Accordingly, this invention provides a new and improved hinge which inhibits the removal of a door while in the closed position. More specifically, the invention provides a hinge assembly with a stud extending from one hinge leaf through an aperture in the other leaf that will prevent the unauthorized removal of the door should the hinge-knuckles or the hinge pin be removed, and either the door shifted to the latch side of the jamb when excessive clearance is present or an attempt be made to saw through the stud. Thus, the invention provides a hinge assembly effective against an intruder possessing a hacksaw or other similar tool.

These and other advantages of the present invention are attained by attaching a security stud to one hinge leaf, and providing a corresponding aperture in the other leaf, the stud being so positioned that it protrudes through the aperture when the hinge (and thereby the door) is in a closed position. The stud is formed of such length that should the hinge knuckles be cut from the leaves or the pin pulled, and the door shifted towards the latch side, the stud remains engaged.

The stud is also formed so that it is rendered resistant to being cut by a hacksaw or other metal cutting instrument. This is accomplished by providing a stud with a centrally drilled blind bore, and inserting into the bore a rolling element of a hardness sufficient to resist cutting. The rolling element may be retained in position by partially closing the entrance to the bore by any suitable means. For example, the stud can be attached by staking it to the leaf and reducing the bore diameter. Alternatively, a ball or slug can be pressed into the bore behind the roller or pin. A stud including a rotatable sleeve of sufficient hardness to resist cutting positioned around a pin may be used in the present invention; a solid stud having a hardness sufficient to be resistant to cutting by a hacksaw blade can also be used.

BRIEF DESCRIPTION OF THE DRAWINGS

For the purpose of illustrating the invention, reference is made to the accompanying drawings, in which:

FIG. 1 is a partial elevation of a hinge embodying the present invention;

FIG. 2 is a view taken along line 2–2 of FIG. 1, illustrating a tapered security stud with an internal hard surface roller for resisting sawing;

FIG. 3 is a top sectional view of the hinge of FIG. 1 with the leaves in an overlying (closed) position and showing a security stud resistant to sawing;

FIG. 4 is a top sectional view of a cylindrical stud with a roller resistant to cutting held in position by a pressed ball;

FIG. 5 is a top sectional view of a tapered security stud with internal engaging balls for resisting sawing;

FIG. 6 is a top sectional view of a cylindrical stud formed by a sleeve resistant to cutting rotatably mounted on a pin; and FIG. 7 is a top sectional view of a cylindrical stud rotatably attached to the hinge leaf.

DESCRIPTION OF THE PREFERRED EMBODIMENTS

Referring to the drawings, a hinge embodying the present invention is shown having a pair of juxtaposed hinge leaves 1 and 2. Along the respective adjacent edges of the leaves lie hinge knuckles 3 and 4. Each hinge knuckle is formed by a cylindrical metal sleeve attached to the edge of its leaf with a bore axis parallel to the leaf edge and co-linear to that of the other knuckles. A number of bearings 5 are provided, each having a bore of equal diameter to, and a bore axis co-linear with, hinge knuckles 3 and 4. A metal hinge pin 8 extends through the cylindrical bore of the hinge knuckles and bearings.

The face of each leaf 1 and 2 is provided with a series of countersunk mounting holes, 9 and 10 respectively, adapted to receive screws. One leaf 2 of the hinge is provided with a security stud 11 described further below. The other leaf 1 has an aperture 14 suitable for receiving the stud 11 when the leaves are in the overlying (closed) position.

As shown in FIG. 2, the security stud 11, tapered to facilitate its entry into the aperture 14, has a centrally drilled bore 15 to receive a roller 16 resistant to cutting. Thus a saw engaging the roller will cause its rotation and will not be able to bite into and saw through the roller. For additional protection, the roller can be formed of a hard steel, can be formed of a metal hardened after fabricating, or can have a case hardened surface. The term "hard surface" when used with the stud or stud roller herein denotes a stud or stud roller formed according to any one of the foregoing descriptions, or by any similar material or method. The bore 17, partially closed after insertion of the roller by staking the stud to the leaf 2, retains the roller in position.

Referring to FIG. 5, several engaging hard surface roller balls 21 resistant to cutting for the reasons the roller 16 is so resistant, can be used in place of the roller 16.

Another tapered security stud 12, shown in FIG. 3, has a centrally drilled bore 29 and is formed of a conventional hard surface metal resistant to sawing, for example a hardened steel. This stud is attached to the leaf by means of a rivet 30 pressed into the bore 29.

A cylindrical stud 13, shown in FIG. 4, has a centrally drilled bore 18 in which is inserted a hard surface roller 19 that resists cutting. A metal ball 20, pressed in place at the entrance, retains the roller in position. This stud requires a slightly larger aperture than the tapered stud.

FIG. 6 illustrates another cylindrical security stud 22 including a pin 23 and formed with a flange 24 which retains in proper position a rotatable cylindrical roller sleeve 25, hence it is resistant to cutting. The sleeve 25 can also be formed of a hard surface metal to make cutting more difficult.

Another security stud 26, shown in FIG. 7, is attached to the leaf 2 by forming a head 27 after its insertion into a slightly oversized mounting aperture 28 formed in the leaf 2. The entire stud is thereby free to rotate with respect to the leaf. The stud 26 may also be formed of a hard surface metal as a further safeguard.

In operation, one hinge leaf with one of the studs 11, 12, 13, 22 or 26, resistant to cutting, is attached to the door, while the other hinge leaf is attached to the jamb. During normal opening and closing of the door, the hinge pivots and the security stud enters and leaves the aperture 14. However, should the hinge pin 8 be removed or the knuckles sawed off while the hinge (and thereby the door) is in the closed position, the stud interferes with any parallel movement of the hinge leaves 1 and 2, thereby preventing removal of the door, as best illustrated in FIG. 3. The stud is also long enough so that any relative perpendicular movement, i.e., displacement of one leaf from the other, possible between the leaves with the hinge pin removed or knuckles sawed off due to clearance between the door and jamb is not sufficient to withdraw the stud 11 from the aperture 14. This can be achieved by having the pin extend beyond the hinge at least about the thickness of one leaf.

In addition, if an attempt is made to remove the door by inserting a hacksaw or similar cutting instrument into the space between the leaves (FIG. 3) and sawing through the stud, it would fail. With the roller insert studs of FIGS. 2 and 4, or the ball insert stud of FIG. 5, after the stud 11 is partially sawed through, the hacksaw blade encounters the internal roller 16 or 19, or the internal balls 21. Such roller or ball rotates with the passing of the hacksaw blade, and thus prevents further cutting.

With the embodiment of the stud described in connection with FIG. 3, the stud 12, being formed of a metal resistant to cutting, resists the hacksaw blade and prevents sawing therethrough.

With the sleeve-stud arrangement described in connection with FIG 6 or the stud of FIG. 7, an attempt to saw through the stud 22 or 26 would likewise fail. Upon engagement by the blade of a hacksaw, the external sleeve 25 or the stud 26 will rotate with the passing of the blade, and thus prevent cutting.

The form of invention described herein is illustrative and may be embodied in other forms while still employing the inventive principles contained herein. Thus, the invention has been described as applicable to a door and corresponding door jamb. The invention is equally applicable to hinges for windows, boxes, and other closures. All such modifications and variations are intended to be within the scope of the invention as defined in the following claims.

I claim:

1. A hinge comprising a pair of adjacent hinge leaves, a plurality of axially aligned hinge knuckles, at least one knuckle on each leaf along the adjacent edge thereof, the knuckles having an aligned bore, a hinge pin axially extending through the aligned bore, a security stud mounted to one leaf, at least a portion of the stud being rotatable with respect to the leaf so that the stud is resistant to cutting, and an aperture in the other leaf through which the stud extends when the leaves are in an overlying position with the hinge closed.

2. A hinge as defined in claim 1, wherein the stud includes a bore, and a rolling element resistant to cutting is positioned in the bore.

3. A hinge as defined in claim 2, wherein the rolling element is a hard surface roller.

4. A hinge as defined in claim 2, wherein the rolling element comprises a plurality of engaging hard surface balls.

5. A hinge as defined in claim 2, wherein an opening is provided in the one leaf, the stud is staked in the one leaf opening, and said staking reduces the bore diameter to retain the rolling element therein.

6. A hinge as defined in claim 2, wherein means are provided at the end of the bore to retain the rolling element therein.

7. A hinge as defined in claim 6, wherein said means comprises a ball.

8. A hinge as defined in claim 1, wherein the stud is rotatably mounted to the leaf.

9. A hinge as defined in claim 1, wherein the stud is tapered to facilitate its extension through the aperture in the other leaf.

10. A hinge as defined in claim 1, in which the stud extends beyond the other hinge leaf a distance at least equal to about the thickness of one leaf to prevent withdrawal of the stud from the aperture when the leaves are displaced one from the other.

11. A hinge comprising a pair of leaves, a plurality of axially aligned hinge knuckles, at least one knuckle on each leaf along the adjacent edge thereof, the knuckles having an aligned bore, a hinge pin axially extending through the aligned bore, a security stud attached to one leaf, the stud tapered to facilitate its extension through the aperture in the other leaf and provided with a bore and hard surface roller positioned in the bore, and an aperture in the other leaf through which the stud extends when the leaves are in an overlying position with the hinge closed.

12. A hinge as defined in claim 11, in which the stud extends beyond the other hinge a distance at least equal to about the thickness of one leaf to prevent withdrawal of the stud from the aperture when the leaves are displaced one from the other.

13. A hinge comprising a pair of leaves, a plurality of axially aligned hinge knuckles, at least one knuckle on each leaf along the adjacent edge thereof, the knuckles having an aligned bore, a hinge pin axially extending through the aligned bore, a security stud attached to one leaf, the stud tapered to facilitate its extension through the aperture in the other leaf and provided with a bore and hard surface balls positioned in the bore, and an aperture in the other leaf through which the stud extends when the leaves are in an overlying position with the hinge closed.

14. A hinge as defined in claim 13, in which the stud extends beyond the other hinge a distance at least equal to about the thickness of one leaf to prevent withdrawal of the stud from the aperture when the leaves are displaced one from the other.

15. A hinge comprising a pair of leaves, a plurality of axially aligned hinge knuckles, at least one knuckle on each leaf along the adjacent edge thereof, the knuckles having an aligned bore, a hinge pin axially extending through aligned bore, a security stud attached to one leaf, the stud including a rotatable sleeve resistant to cutting positioned around a pin, means for retaining the sleeve on the pin, and an aperture in the other leaf through which the stud extends when the leaves are in an overlying position with the hinge closed.

16. A hinge as defined in claim 15, in which the stud extends beyond the other hinge a distance at least equal to about the thickness of one leaf to prevent withdrawal of the stud from the aperture when the leaves are displaced one from the other.

17. A hinge as defined in claim 15 wherein the sleeve is formed of a hard surface metal.

* * * * *